US006513778B2

(12) United States Patent
Hefley et al.

(10) Patent No.: US 6,513,778 B2
(45) Date of Patent: Feb. 4, 2003

(54) BRACING DEVICE

(75) Inventors: R. Duane Hefley, Bellaire, TX (US); Kenneth A. Strode, Houston, TX (US); Michael S. Andrich, Houston, TX (US)

(73) Assignee: Evertax Corporation, Houston, TX (US)

( * ) Notice: Subject to any disclaimer, the term of this patent is extended or adjusted under 35 U.S.C. 154(b) by 0 days.

(21) Appl. No.: 09/781,467

(22) Filed: Feb. 12, 2001

(65) Prior Publication Data

US 2002/0153464 A1 Oct. 24, 2002

Related U.S. Application Data

(60) Provisional application No. 60/232,315, filed on Sep. 14, 2000.

(51) Int. Cl.[7] ..... A47F 5/00; E05C 17/44

(52) U.S. Cl. ..... 248/351; 292/259 R; 292/338; 292/339

(58) Field of Search ..... 248/351, 354.1, 248/188.1, 188.5, 357, 910; 292/339, 338, 342, 343, 259 R, DIG. 15

(56) References Cited

U.S. PATENT DOCUMENTS

| | | | | | |
|---|---|---|---|---|---|
| 1,606,149 | A | * | 11/1926 | Crewson | 292/338 |
| 3,001,754 | A | * | 9/1961 | Fowler | 248/357 |
| D219,362 | S | * | 12/1970 | Snyder | D8/203 |
| 4,157,128 | A | | 6/1979 | Peters | 182/24 |
| 4,290,636 | A | | 9/1981 | Steele | 292/338 |
| 4,563,027 | A | | 1/1986 | Chechovsky et al. | 292/339 |
| 4,576,354 | A | * | 3/1986 | Blessing | 248/354.5 |
| 4,676,536 | A | | 6/1987 | Arbic et al. | 292/339 |
| 4,819,296 | A | * | 4/1989 | Wilkins | |
| 4,822,086 | A | | 4/1989 | Brown | 292/338 |
| 4,971,374 | A | | 11/1990 | Lovell et al. | 292/339 |
| 5,064,232 | A | | 11/1991 | Quarberg | 292/339 |
| 5,098,138 | A | | 3/1992 | Vandewege | 292/66 |
| 5,218,341 | A | | 6/1993 | Marik | 340/546 |
| 5,286,075 | A | | 2/1994 | Monzingo | 292/339 |
| 5,330,403 | A | * | 7/1994 | Kuo | 482/83 |
| 5,333,922 | A | | 8/1994 | Jones | 292/339 |
| 5,340,175 | A | | 8/1994 | Wood | 292/339 |
| 5,392,026 | A | | 2/1995 | Marik | 340/546 |
| 5,398,982 | A | | 3/1995 | Watson, Jr. | 292/259 R |
| 5,544,386 | A | * | 8/1996 | Cobb | 16/82 |
| 5,676,410 | A | | 10/1997 | Angerbrandt | 292/338 |
| 5,711,560 | A | * | 1/1998 | Gilbertson | 292/343 |
| 5,765,416 | A | * | 6/1998 | Cote | 70/238 |
| 5,988,710 | A | | 11/1999 | Kortschot et al. | 292/339 |
| 6,120,072 | A | * | 9/2000 | Benedict | 292/338 |
| 6,372,323 | B1 | * | 4/2002 | Kobe | 428/119 |

* cited by examiner

*Primary Examiner*—Leslie A. Braun
*Assistant Examiner*—Amy J. Sterling
(74) *Attorney, Agent, or Firm*—Kurt D. Van Tassel; Deborah G. VandenHoff; Van Tassel & Associates

(57) ABSTRACT

A bracing device for bracing a first surface against a second surface is useful for emergency response, commercial, industrial and residential environments. The bracing device has a bracing member with a first end and a second end. A first end member affixed to the first end has a sufficient curvature to produce a substantially convex shape over at least a portion of the end member's external surface for frictionally engaging the first surface. The radius of the convex curvature is predetermined so that the bracing device may be readily adapted to a predetermined range of bracing distances between the first and second surfaces so that the desired bracing strength can be obtained.

25 Claims, 7 Drawing Sheets

BRACING DEVICE

This application claims the benefit of U.S. Provisional Application, Ser. No. 60/232,315, filed in the names of R. Duane Hefley, Kenneth A. Strode and Michael S. Andrich on Sep. 14, 2000.

FIELD OF THE INVENTION

The present invention relates to a bracing device and, in particular, to a bracing device for emergency response, commercial, industrial and residential environments.

BACKGROUND

There is often need for a portable, readily adaptable and temporary bracing device in a wide array of emergency response, commercial, industrial or residential environments.

For example, in emergency response environments there is a frequent need for a portable bracing device that can be reused or, if necessary, sacrificed, so emergency response personnel can safely extract an accident victim lodged between solid surfaces on the verge of collapse. Also, such a bracing device could be used by fire safety personnel to ensure that walls and/or ceilings that have been weakened by fire or heat exposure do not collapse in their work area.

Further, in certain commercial/industrial environments, there may be a need to temporarily strengthen or support a wall surface against a floor surface or to prevent two opposing surfaces, such as a ceiling opposing a floor surface or two opposing wall surfaces from collapsing on each other. Such situations can arise, for example, without limitation, in the case of building construction or demolition or trench excavation.

And in the case of residential environments, there is a particular need for a bracing device that can be used in home improvement and construction applications as well as for security applications. For example, there may be a need to temporarily strengthen or support surfaces in the orientation described above under commercial/industrial environments. But as well, there is a need for enhancing the security of certain doors, windows and other possible entryways against potential intruders. Typically, for doors secured by a deadbolt, there is usually about only ½ inch of wood in a door jamb for securing the door against a forced entry. For instance, according to 1996 FBI statistics, there were about 2.5 million burglaries in the U.S., of which about 77% were by forced entry. And 80% of forced entry burglaries were executed by kicking an entry door (i.e., kick burglary). Accordingly, kick burglaries are the method of choice for most burglaries in the U.S.

To address this need for improved home security, numerous products have been produced including door security bars or supplemental strength supports for doorjambs. However, all of these devices either require installation of hardware into or on the door to provide effective bracing strength and/or are cumbersome to implement.

Most particularly, the conventional devices used for bracing a door lack a design for optimally adapting to a wide range of door types, hardware and environments in both a convenient and efficient manner. For instance, many conventional door security bars are extendable to a range of lengths in order to adapt to a range of different door environments, hardware type and hardware placement. Conventional door security bars typically have a cradle for engaging a door knob, a pivoting flat foot for engaging a floor surface and an adjustable length bar between the cradle and foot. Examples of such door security bars are described in U.S. Pat No. 5,340,175 (Wood, Aug. 23, 1994), U.S. Pat. No. 5,333,922 (Jones, Aug. 2, 1994), U.S. Pat No. 5,064,232 (Quarberg, Nov. 12, 1991), U.S. Pat. No. 4,563,027 (Chechovsky, Jan. 7, 1986), U.S. Pat. No. 5,286,075 (Monzingo, Feb. 15, 1994), U.S. Pat. No. 5,988,710 (Kortschot et al., Nov. 3, 1999), U.S. Pat. No. 4,676,536 (Arbic et al., Jun. 30, 1987) and U.S. Pat. No. 4,157,128 (Peters, Jun. 5, 1979). The adjustable bars described in Marik's U.S. Pat. No. 5,218,341 (Jun. 8, 1993) and U.S. Pat. No. 5,392,026 (Feb. 21, 1995) are curved in an attempt to keep the feet flat on the floor surface. U.S. Pat No. 4,971,374 (Lovell et al., Nov. 20, 1990) describes a door security device having a cradle for engaging a door knob, a flat foot for engaging the floor and an adjustable bar between the cradle and foot. However, Lovell et al.'s flat foot does not pivot.

Other door security devices described in U.S. Pat No. 5,398,982 (Watson, Jr., Mar. 21, 1995), U.S. Pat No. 4,290,636 (Steele, Sep. 22, 1981), U.S. Pat. No. 5,676,410 (Angerbrandt, Oct. 14, 1997), U.S. Pat. No. 4,822,086 (Brown, Apr. 18, 1989) and U.S. Pat No. 5,098,138 (Vandewege, Mar. 24, 1992) require hardware to be mounted to the door and/or the floor in order to use the device.

All of these door bracing devices suffer from at least four basic deficiencies.

First, they use a relatively rigid, substantially planar foot member that has a greater tendency to slip on the surface it contacts unless the bracing bar's length is adjusted to obtain optimal contact between the foot member's surface that interfaces with the opposing surface ("foot member contact surface area"), which is typically a floor surface. Consequently, these devices invariably require the end user to use some judgment in selecting the most appropriate bar length for ensuring the bracing device can provide the necessary bracing strength. Moreover, some users, for various reasons, tend to mistakenly select the wrong length in trying to optimize the foot member contact surface area.

Second, even if the device's length is properly adjusted, there is a substantial likelihood that the device will be used to brace another door with a different door knob height, but without adjusting the device's length accordingly. In such a case, the foot member contact surface area is reduced. And, with a reduction in the foot member contact surface area, the bracing device's foot member is more prone to slippage, at a lower external pressure or force than the foot member is designed to withstand.

Third, even if the device's length is properly adjusted, there is a substantial likelihood that during installation the bracing device will be placed somewhat off-center with its optimum alignment with the door. This is a relatively common installation error with conventional devices. By "optimum alignment," we mean the bracing device is in alignment with an imaginary line that is directly perpendicular to the door's face and extends outwardly from the door handle's axis of rotation. Naturally, as the bracing device's degree of deviation from the optimum alignment increases, its strength is diminished accordingly, at which degree of deviation a particular bracing device will fail depends substantially on the ability the foot member to adapt to and therefore adequately engage the floor surface when the bracing member is not optimally aligned. But, because conventional devices use a relatively rigid, substantially planar foot member, they generally have a poor adaptability factor and hence cannot effectively engage the floor surface when the bracing member is not optimally aligned.

Fourth, even if the device's length is properly adjusted, there is a substantial likelihood that device will be installed against a floor surface that has surface irregularities. Such surface irregularities can reduce the foot member contact surface area, particularly when the foot member has a relatively rigid and substantially planar construction. Again, with a reduction in the foot member contact surface area, the bracing device's foot member is more prone to slippage, at a lower external pressure or force than the foot member is designed to withstand.

Likewise, in the context of bracing devices used in non-security applications the bracing devices are typically implemented by adjusting the bracing member's length and using fasteners (e.g., nails, screws, bolts, etc.) and/or hardware to attach the bracing device to each surface being braced.

Accordingly, there is need for a bracing device that can readily adapt to bracing two surfaces against each other, while providing the desired bracing strength. More specifically, there is a need for a temporary bracing device that can readily adapt, without requiring supplemental surface hardware and/or fasteners, to a wide range of angles and distances for providing the desired bracing strength between two surfaces, whether for commercial/industrial, residential, emergency response and/or safety applications. Preferably, such a bracing device can provide a continuous range of angles at which the bracing device can be placed for producing the desired bracing strength, but without requiring an adjustment to the device's length. And most preferably, where the size of the device permits, can be implemented with a one-handed operation.

SUMMARY OF THE INVENTION

According to the invention, there is provided a bracing device for bracing a first surface against a second surface, the device comprising:

(a) a bracing member having a first end and a second end, and a first end member affixed to the first end, wherein (b) at least a portion of the first end member has a substantially convex curvature and material adapted to frictionally engage the first surface; and (c) the second end is adapted to engage the second surface.

BRIEF DESCRIPTION OF THE DRAWINGS

The bracing device of the present invention will be better understood by referring to the following detailed description of preferred embodiments and the drawings referenced therein for illustrative purposes, in which.

DETAILED DESCRIPTION

Figure 1A:
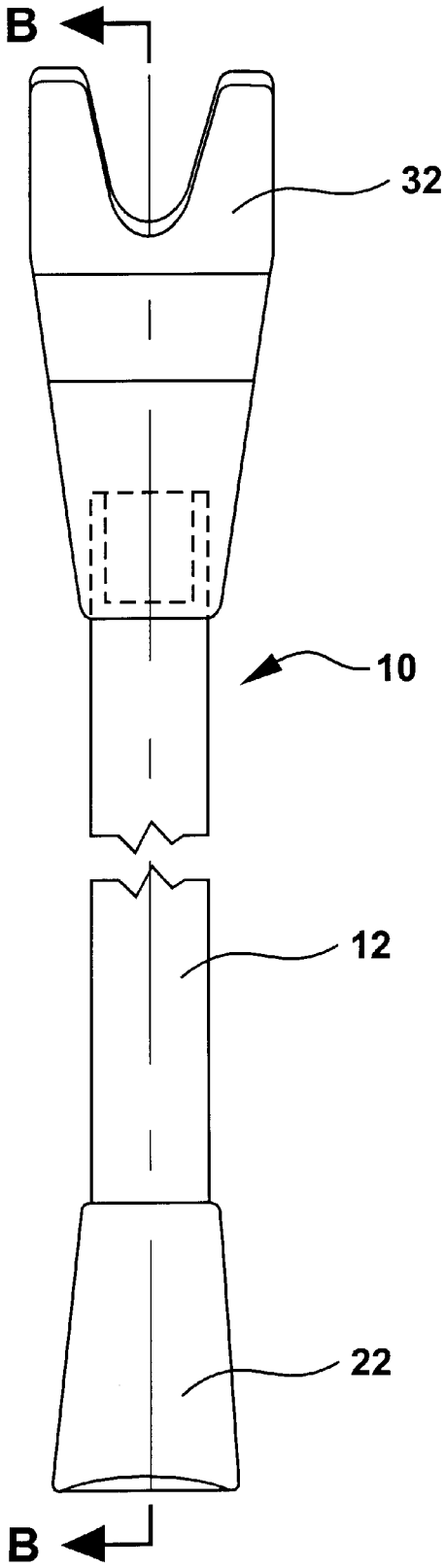
FIG. 1A is a front elevational view of one embodiment of a bracing device, preferably for use in a residential or commercial environment.
Figure 1B:
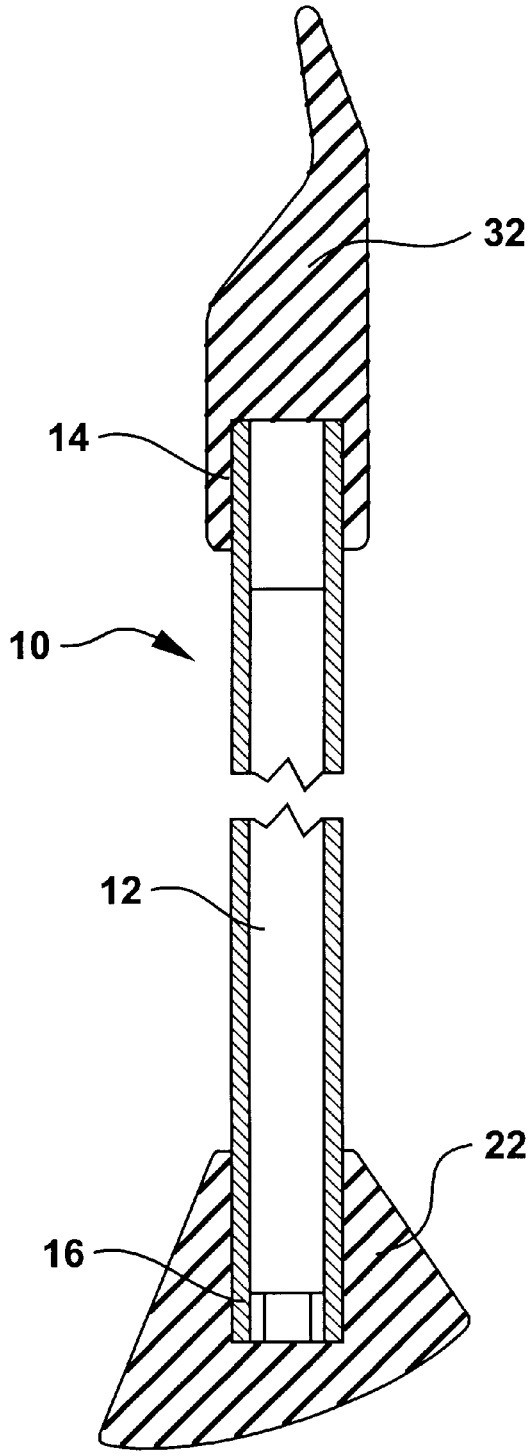
FIG. 1B is a side elevational view in cross-section of the bracing device of FIG. 1A along the line B—B.

One embodiment of the bracing device is illustrated in FIGS. 1A and 1B. The bracing device 10 has a bracing member 12, having a first end 16 and a second end 14, and a first end member 22 affixed to the first end 16. Optionally, a second end member 32 is affixed to the second end 14. At least a portion of the first end member 22 has a sufficient curvature to produce a substantially convex shape (hereinafter "convex end member") over at least a portion of the end member's external surface. The radius of the curve used to produce the convex shape (i.e., radius of convex curvature) is predetermined so that the bracing device 10 may be readily adapted to an optimal angle and bracing distance between first and second surfaces for producing an acceptable bracing strength under the intended application. By "bracing distance," we mean the length of a straight line spanning between the areas of engagement for the convex end member 22 and the bracing member's second end 14 or second end member 32, if any, with the first and second surfaces, respectively (not shown).

Convex End Member

The convex end member 22 is formed with a material for frictionally engaging a first surface. The hardness of the material used to form the convex end member 22 is dependent on the intended application and the friction coefficient between the convex end member 22 and the type of surface it will engage. However, in general, the material should be hard enough to withstand significant impact but soft enough for frictional engagement under the intended application.

In a sense then, the convex end member 22 has some "tire-like" properties in terms of its compressibility and ability to adapt to the surface it interfaces with. Consequently, by selecting the appropriate hardness, width and degree of curvature for the convex end member 22, in accordance with the intended application, it will be apparent to one skilled in the art, in view of the description below, that the present invention can be used in a diverse array of applications. Preferably, the properly constructed and designed convex end member 22 is used in combination with the appropriate fixed length bracing member 12, discussed more fully below. But the convex end member 22 may also be used, as appropriate, with an adjustable length bracing member (not shown). Of course, the convex end member 22 inherently provides two primary benefits not found in conventional bracing devices.

First, the convex end member's curvature allows the bracing device 10 to be easily adapted to a wide range of angles so that it can be snugly and securely fitted between two opposing surfaces (not shown) without requiring an adjustment to the length of the bracing member 12. Of course, this is particularly significant when a fixed-length bracing member 12 is used to construct the bracing device 10, so that the bracing member 12 has a higher compression strength. Moreover, this novel feature helps eliminates the guess work for the end user in selecting an appropriate length to optimize foot member contact surface area. It also provides a simple and convenient method for ensuring the end user will have an acceptable bracing strength to the extent the bracing device 10 is simply put in place.

Second, the convex end member's curvature gives it the ability to conform and compress, in accordance with its hardness, when subjected to increasing pressure or force. This means the convex end member 22, in accordance with its hardness, can provide increasing contact surface area as greater force is applied against it. Again, this feature helps better ensure the effectiveness of the bracing device 10 over a wide range of distances for a fixed-length bracing member 12. Also, this feature provides increasing contact surface area between the convex end member 22 and opposing surface (not shown), as increasing pressure or force is applied against the bracing device 10. Accordingly, the convex end member 22 improves the bracing device's resistance to increasing pressure or force.

The convex end member 22 preferably has a Shore A durometer, as measured by ASTM D2240, incorporated herein by reference. Preferably, the material has a Shore A durometer hardness in a range of from about 25 to about 95. More preferably, the material has a Shore A durometer hardness in a range of from about 40 to about 85. Most preferably, the material has a Shore A durometer hardness in a range of from about 60 to about 80.

The convex end member 22 may be formed from a solid piece of material or it may be formed from a composite of materials, where, for example, it can be formed from a first core material and a second external layer material. Preferably, the second external layer material has a Shore A durometer hardness in a range of from about 25 to about 95. More preferably, the material has a Shore A durometer hardness in a range of from about 40 to about 85. Most preferably, the second external layer material has a Shore A durometer hardness in a range of from about 60 to 80.

Figure 2:
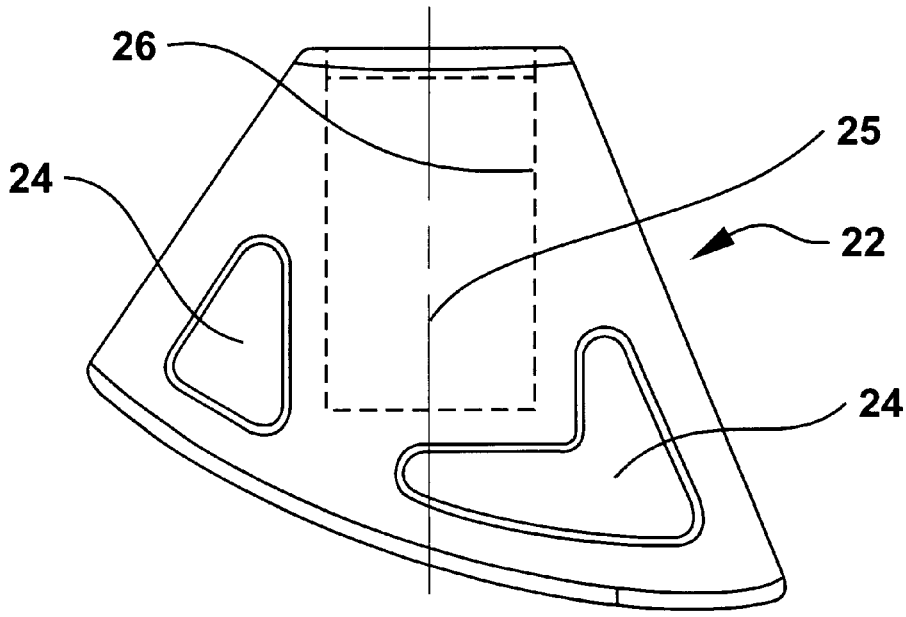
FIG. 2 is a side elevational view of one embodiment of a convex end member of the bracing device.
Figure 4B:
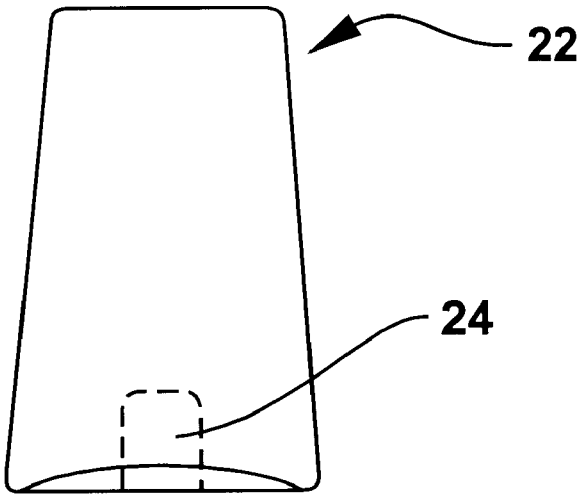
FIG. 4B is a front elevational view of the convex end member of FIG. 4A.
Figure 4A:
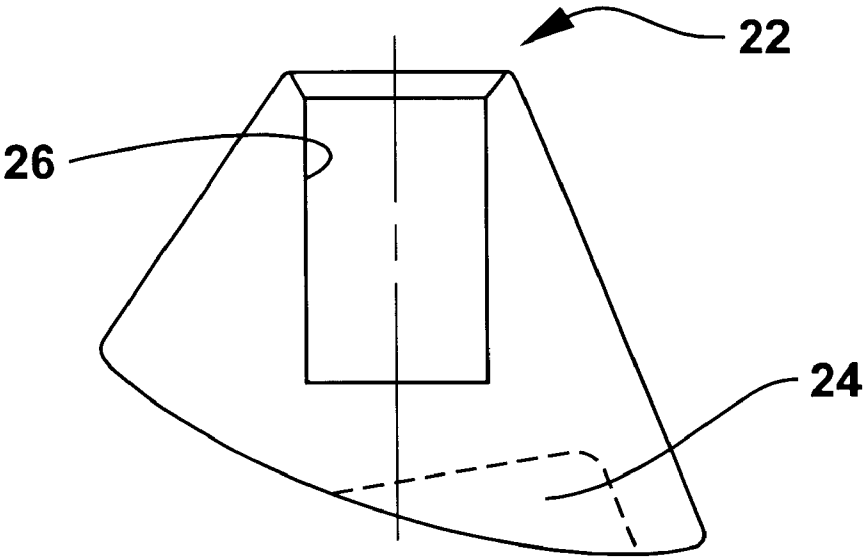
FIG. 4A is a side elevational view of another embodiment of a convex end member of the bracing device.

The convex end member 22 formed from a solid piece of material or a composite of materials may itself be solid, as shown in the embodiment in FIG. 1A, or with cut-outs 24 extending through or partially through the convex end member 22, as shown in the embodiments in FIGS. 2, 4A and 4B, for example, (1) to reduce the weight of the convex end member 22 and/or (2) to increase compression, thereby increasing surface area contacting the first surface and the frictional engagement with the first surface.

Examples of suitable materials for the convex end member 22 include, thermoset or thermoplastic materials, including, without limitation, polyurethane, silicone, natural rubber, styrene butadiene rubber, isobutylene, isoprene, polybutadiene, polyethylene, polypropylene, neoprene, acrylonitrile, acrylic, and combinations thereof. Depending on the application, the material of construction for the convex end member 22 may be selected for its resistance to fire, heat, cold, chemicals, and/or electrical conductivity.

In one embodiment, the convex end member 22 may be inflatable with gas and/or liquid to a pressure sufficient to withstand impact, while maintaining its ability to frictionally engage a surface. In this embodiment, the convex end member 22 may be inflated prior to being placed in position or it may be inflated once in position.

An inflatable convex end member 22 may be a two-part structure with an external synthetic or natural rubber and an internal bladder. The inflatable convex end member 22 is inflatable to a suitable pressure for producing the desired coefficient of friction. For example, depending on the application, the inflatable convex end member 22 can be inflated up to 200 psi. This embodiment may be particularly suitable for applications where the bracing device 10 is first placed between two objects and then the convex end member(s) 22 is inflated to move one of the objects in relation to the other.

The radius and arc length of the convex end member 22 is dependent on the application for which it will be used. By radius, we mean the distance measured from a circle's center point to the circle's perimeter, wherein a predetermined portion of the circle's perimeter defines the convex end member's substantially convex curvature. By arc length, we mean the length of a predetermined portion of the circle used to define the extent of the convex end member's curvature.

Preferably, the radius of the curve used to produce the convex end member's shape is in a range of from about 1 inch to about 48 inches. For a residential or commercial security application, the curve radius of the convex end member 22 is preferably in a range of from about 1 inch to about 7 inches.

Preferably, the arc length of the convex end member 22 is in a range of from about 1.5 inches to about 151 inches, depending on the intended application. For a residential or commercial security application, the arc length of the convex end member 22 is preferably in a range of from about 1 inch to about 7 inches.

The arc surface of the convex end member 22 may be substantially smooth or treated to assist in frictional engagement with the surface. Such treated surfaces include, without limitation, convoluted, ridged, cross-hatched or spiked surfaces.

Figure 3:
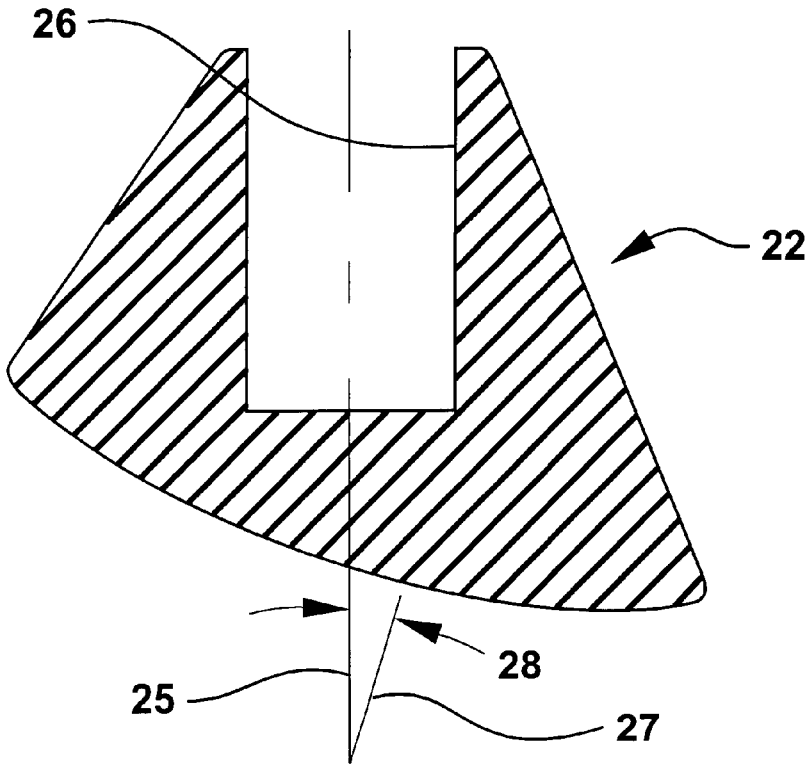
FIG. 3 is a side elevational view of the convex end member of FIG. 2 in cross-section illustrating a produced angle.

As shown in FIG. 3, the convex end member 22 preferably has at least one aperture 26, but may have multiple apertures. Preferably, the aperture centerline 25 of the aperture 26 relative to a radius line 27, which defines the radius of the convex end member's curvature, produces an angle 28 between the aperture centerline 25 and radius line 27 in a range from about zero degrees to about 90 degrees. An example of a produced angle 28 is shown in FIG. 3. More preferably, the produced angle 28 between the aperture centerline 25 and radius line 27 is in a range from about 5 degrees to about 75 degrees. Most preferably, the produced angle 28 between the aperture centerline 25 and radius line 27 is in a range from about 10 degrees to about 30 degrees.

Second End Member

Although the bracing member 12 is preferably used with a second end member 32, the second end 14 of the bracing member 12 may be used without a second end member 32 to engage the second surface in certain applications. For example, in a residential or commercial security application, such a device may be used to brace a sliding door against a frame. The second end 14 of the bracing member 12 may be placed in a corner of the sliding door frame and the convex end member 22 is then used against the edge of the sliding door to brace the door against the frame.

Figure 8A:
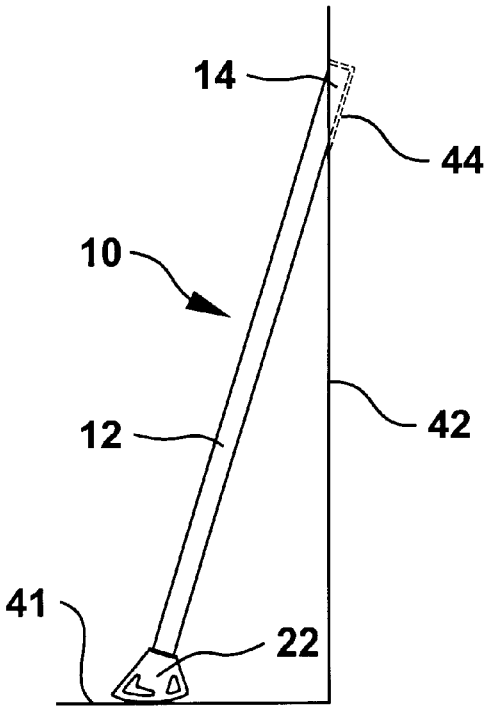
FIGS. 8A and 8B illustrate embodiments for inserting a second end of the bracing device into an aperture on a second surface.
Figure 8B:
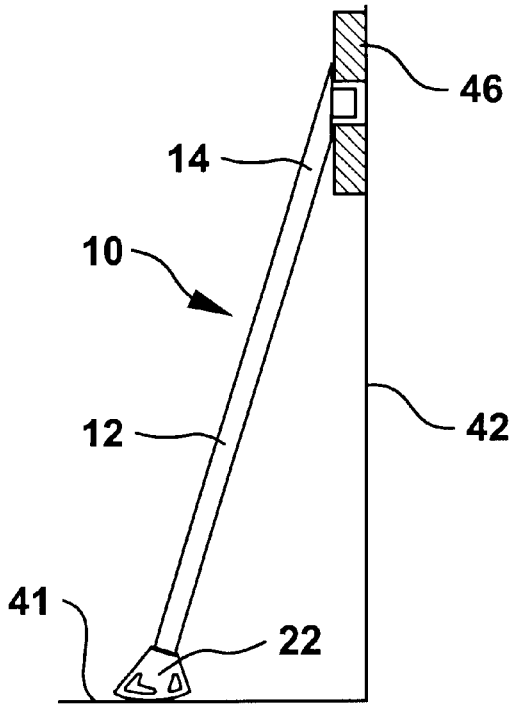

In another residential or commercial security application, a door may have an aperture for engaging the second end 14 of the bracing member 12. Such an aperture may be made directly into the door, for example as illustrated by aperture 44 in FIG. 8A. Alternatively, the aperture may be provided by hardware 46 mounted on the door or on hardware already in place on the door, for example as illustrated in FIG. 8B.

However, there are other applications for which it may be preferable to have a second end member affixed to the second end 14 of the bracing member 12.

Figure 5A:
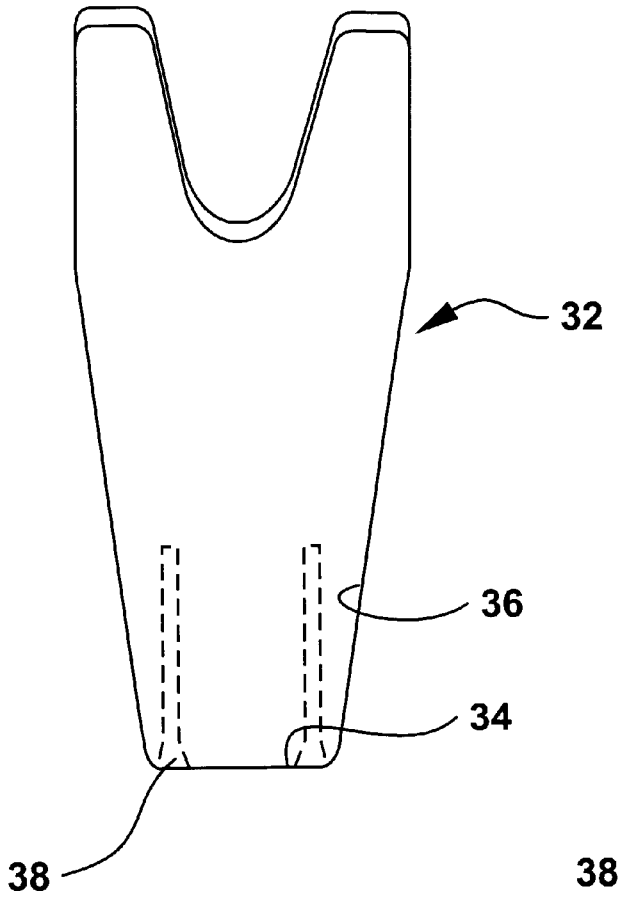
FIG. 5A is a front elevational view of one embodiment of a fork-shaped end member of the bracing device.
Figure 5B:
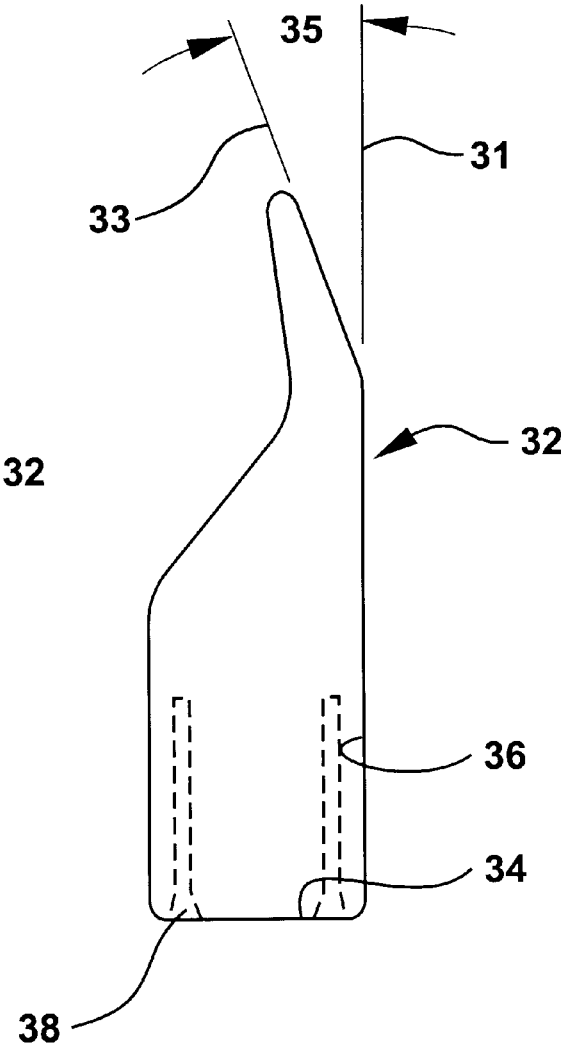
FIG. 5 is a side elevational view of the fork-shaped end member of FIG. 5A.

For example, for door bracing applications, the second end member has a cradling means for engaging at least a portion of the hardware affixed to a door. For example, a second end member with cradling means may be a Y or C fork-shaped end member 32, as shown in FIGS. 5A and 5B, for engaging a door knob or door handle, preferably around at least a portion of the knob or handle shaft. A portion of the fork-shaped end member 32 may be angled with respect to a longitudinal axis 31 of the fork-shaped end member 32 to facilitate placement of the bracing device 10. An embodiment of an angle 35 between the longitudinal axis 31 and a fork axis 33 is shown more clearly in FIG. 5B. In this application, the fork-shaped end member 32 may be formed of a Shore D or other durometer index material suitable for the desired application. In this embodiment, preferably, the fork-shaped end member 32 has a Shore D durometer hardness in a range of from about 30 to 95. More preferably, the Shore D durometer hardness is in a range from about 40 to about 85. In a most preferred embodiment of such a door security application, the fork-shaped end member 32 has a Shore D durometer hardness of about 55 to about 75.

Examples of suitable materials for the fork-shaped end member 32 include thermoset and thermoplastic materials such as, without limitation, polyurethane, polypropylene, neoprene, natural rubber and combinations thereof. Depending on the application, the material of construction for the fork-shaped end member 32 may be selected for its resistance to fire, heat, cold, chemicals, and/or electrical conductivity.

Figure 9:
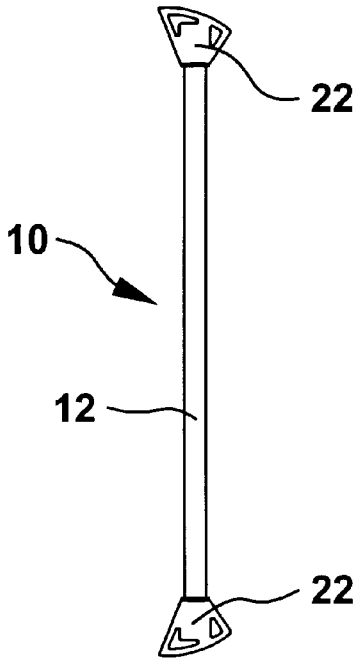
FIG. 9 illustrates an embodiment having two convex end members.

In another embodiment, for example for emergency and construction applications, the second end member may also be a convex end member constructed from material adapted to frictionally engage the second surface, as described above. Accordingly, both ends of the bracing member 12 would have convex end members connected thereto, as illustrated in FIG. 9. In this case, both the first and second end members have a convex shape suitable for providing a continuous range of angles at which the bracing device 10 can be placed for producing the desired bracing strength without the need for adjusting the device's length.

Preferably, at least a portion of the second end member has a tubular connector for connecting the second end member to the bracing member. In a preferred embodiment, the tubular connector has at least a male component 34 adapted to substantially conform to the inside diameter of a substantially hollow second end of the bracing member 12. Alternatively, the tubular connector is a sleeve 36 adapted to substantially conform to the bracing member's outside diameter. In a more preferred embodiment, the tubular connector has both a male component 34 to conform to the inside diameter of a second end of the bracing member 12 and a sleeve 36 circumscribing the male component 34 and annulus 38 located therebetween to conform to the bracing member's outside diameter. An embodiment of the tubular connector having a male component 34 and a sleeve 36 is illustrated in FIGS. 5A and 5B.

Bracing member

The bracing member 12 is preferably a single component that is preferably tubular, which may be substantially hollow, substantially solid or a combination thereof. The tubular cross-section may be circular, triangular, rectangular, pentagonal, hexagonal, heptagonal, octagonal, or any other suitable polygonal shape for the desired application. The outer surface of the bracing member 12 may be, without limitation, smooth, textured or have longitudinal, spiral, circumferential ridges or a combination thereof.

Depending on the application and configuration, the bracing member 12 may be formed of plastic, metal, wood, composite materials, and combinations thereof. Two examples of suitable composite materials are fiberglass and filament graphite based material. For example, depending on the application, the material of construction for the bracing member 12 may be selected for its resistance to fire, heat, cold, chemicals, and/or electrical conductivity.

Because the convex curvature of the convex end member 22 provides a continuous range of angles at which the bracing member 12 can be effectively placed between the first and second surfaces, a single component substantially linear bracing member 12 of a predetermined length is adaptable for a predetermined range of bracing distances between two surfaces, as dictated by the intended application. Of course, one of the benefits of using a convex end member 22 is that the bracing device 10 can be made using a single component, substantially linear bracing member 12, which is preferable for many bracing applications. However, the benefit of the convex curvature will also arise when the convex end member 22 is joined with a substantially non-linear bracing member (not shown), whether a single component or multi-component member. A substantially non-linear bracing member that could be attached to a convex end member 22 may have for example, without limitation, a curved, angular, spiral or accordion shape or some combination thereof.

For example, in a residential or commercial security application, the first and second surfaces may be a door and a floor, respectively. Door knobs and handles are typically placed at a height in a range of from about 34 inches to about 40 inches from the base of the door. With the convex end member 22, a single component bracing member 12 of a predetermined length is adaptable to all such door knob and handle heights. This feature is also advantageous for bracing a sliding door against the frame for a range of sliding door widths.

The single component bracing member 12 is preferred because it is simple for a person to install and remove. Also, the bracing member 12 is typically stronger when it is a single component.

Figure 7A:
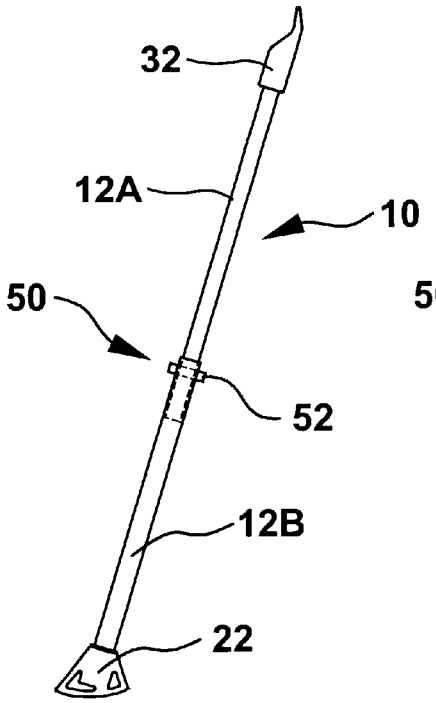
FIGS. 7A to 7E illustrate embodiments for connecting two or more components of a bracing member for the bracing device of FIG. 1A.
Figure 7B:
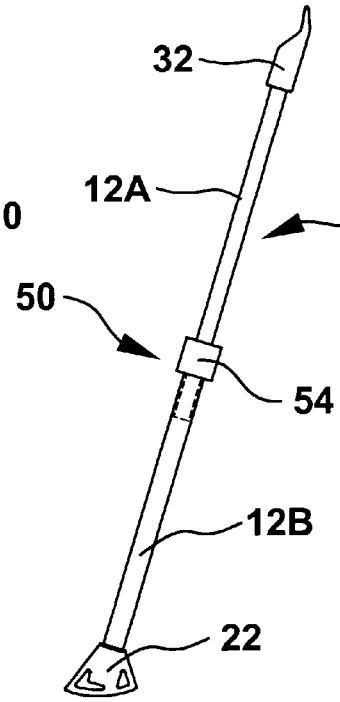

However, there are applications where the bracing member 12 is preferably a multiple component member. Two or more bracing member components 12A, 12B may be connected to one another by a connector means 50 in FIGS. 7A–7E. For example, as illustrated in FIGS. 7A and 7B, the bracing member components 12A, 12B may have different diameters to enable one or more components to be telescoped from the bracing member having the largest inside diameter. In this case, the combined length of the telescoping bracing member sections can be adjusted to a desired length by aligning appropriate pinholes on each bracing member section and secured at that length by inserting a pin 52 (FIG. 7A). Telescoping members may also be adjusted to a predetermined length by a collar 54 (FIG. 7B) attached to the member having the largest outside diameter, so that rotation of the collar 54 frictionally secures a telescoping member in position relative to the outer member. Of course, the pin 52 or collar 54 securing means should have sufficient strength for withstanding the intended force and/or applied pressure that the bracing member will be subjected to.

Figure 7C:
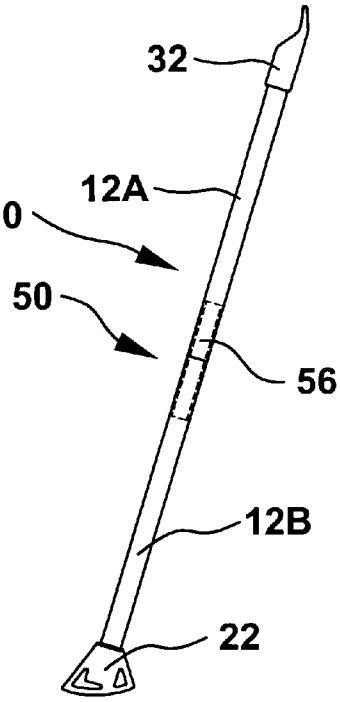
Figure 7D:
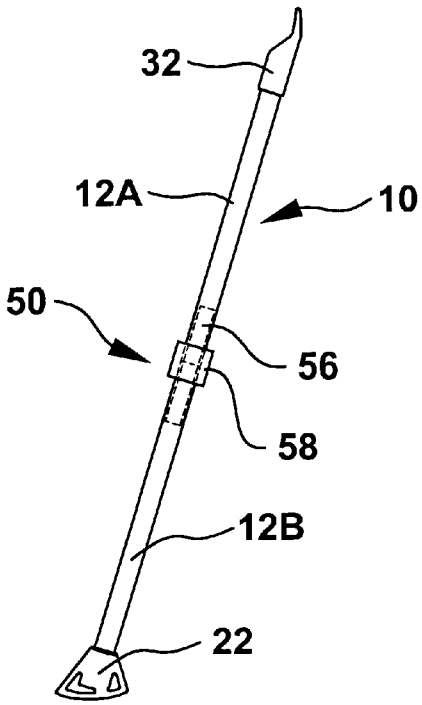
Figure 7E:
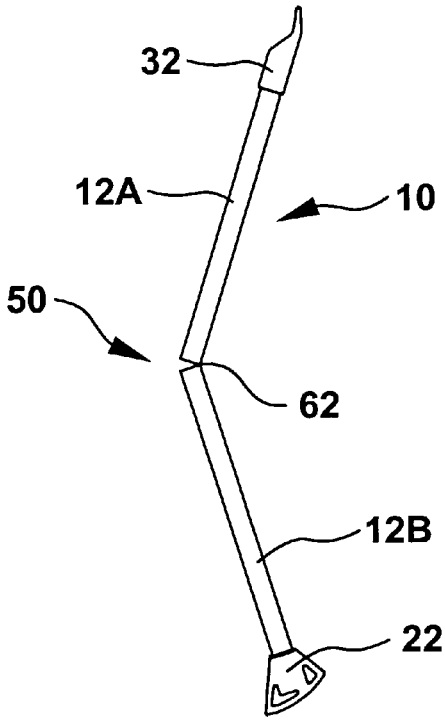

In the embodiment illustrated in FIGS. 7C and 7D, the connector means 50 is a male component 56 adapted to substantially conform to the inside diameter of one or both substantially hollow bracing member components 12A, 12B. In FIG. 7D, the connector means 50 also has a sleeve 58 circumscribing the male component 56 with an annulus adapted to substantially conform to the outside diameter of the bracing member components 12A, 12B.

In another embodiment, the multiple component members 12A, 12B are connected by connector means 50, optionally together with a locking collar or other locking device, so that when the bracing member is extended, the connector means 50 can be locked to hold the multiple component members 12A, 12B in alignment. One example of a suitable connector means 50 for such a purpose is a locking hinged connector 62, illustrated in FIG. 7E, like that commonly found in many folding lock blade knives.

In another embodiment, the multiple component members are ratchetly interconnected so that, in use under certain applications, the length of the bracing member can be adjusted with an appropriate ratcheting means adapted to the bracing member. This embodiment may be particularly applicable for emergency response situations, for example, where a car or other object has been overturned and must be propped up and/or set in an upright position.

Application

Figure 6:
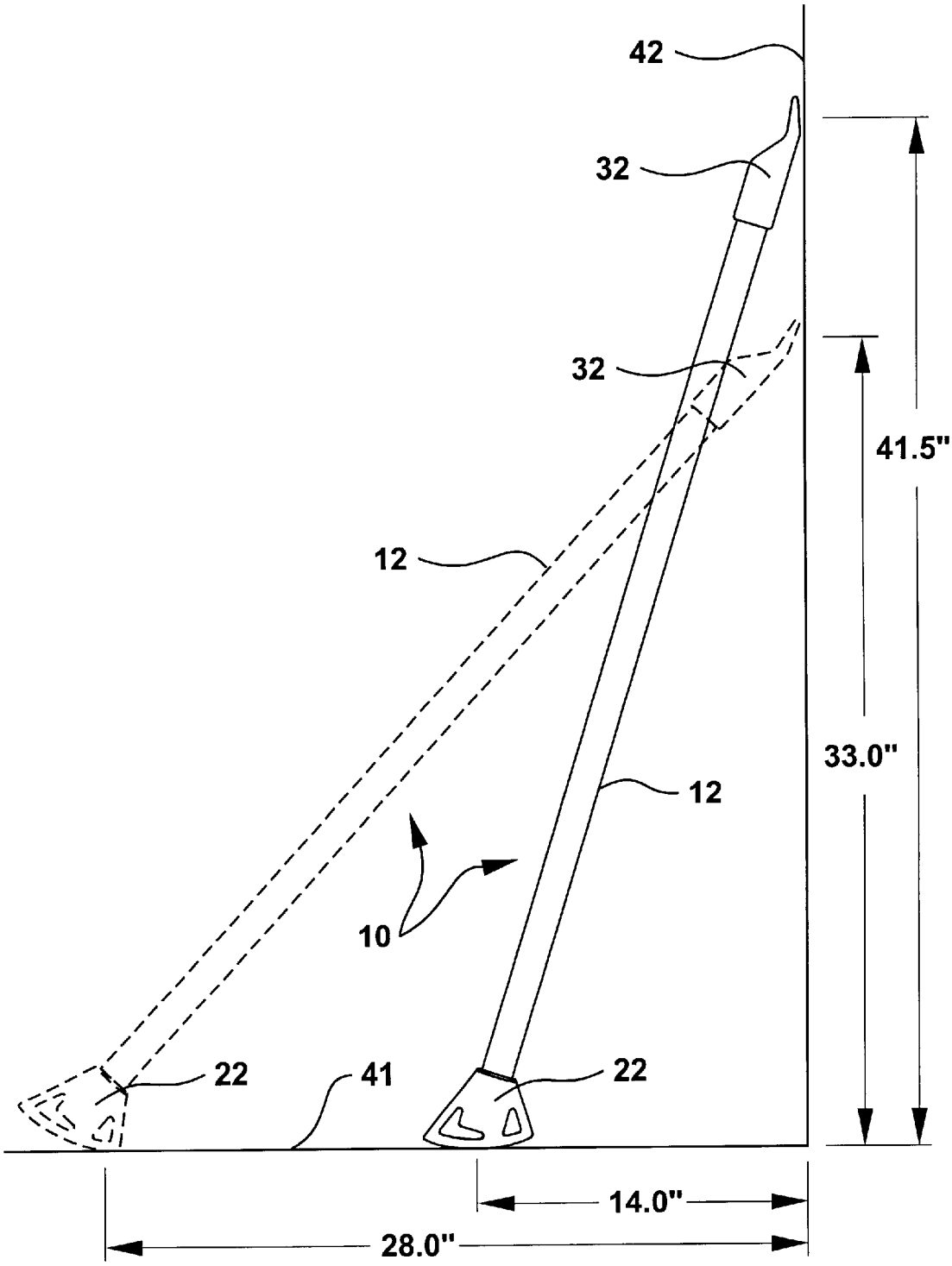
FIG. 6 illustrates the bracing device of FIG. 1A in use at two different angles.

FIG. 6 illustrates the bracing device 10 of FIG. 1A in use at two different angles. In the application shown in FIG. 6, the first and second surfaces are perpendicular to each other. In one type of security application, the first surface is a floor surface 41 and the second surface is a door surface 42. As mentioned earlier, door knobs and handles (not shown in FIG. 6) are typically placed at a height in a range of from about 34 to about 40 inches from the base of a door. FIG. 6 illustrates how a bracing device 10 is adaptable to a range of angles and bracing distances between first and second surfaces, without adjusting the length of the bracing member 12.

In a first position in FIG. 6, the bracing device 10 engages the door surface 42 at 33 inches above the floor surface 41 and frictionally engages the floor surface 41 at 28 inches from the door surface 42. In a second position in FIG. 6, the bracing device 10, which is the same length as the bracing device 10 in the first position, engages the door surface 42 at 41.5 inches above the floor surface 41 and frictionally engages the floor surface 41 at 14 inches from the door surface 42. As can be seen from FIG. 6, because the distance between the floor surface 41 and the door surface 42 is different in each position, the convex end member 22 contacts the floor surface 41 at different points along its radius. However, in both positions, the bracing device 10 provides the desired bracing strength, without adjusting the bracing member's length. This represents a significant improvement over conventional devices, which have no convex shaped surfaces, but rather substantially flat end members for frictionally engaging the floor surface 41.

While the surfaces shown in the FIG. 6 example are perpendicular to each other, it will be understood that the bracing device 10 can be used for other angles of orientation and connectivity between the first and second surface. For example, two surfaces may be completely disconnected or connected, directly or indirectly, to each other. Also, such surfaces may substantially be parallel, whether vertically or horizontally parallel, or perpendicular (as in the case of FIG. 6) or at any other angle relative to each other. Consequently, the orientation that a bracing device 10 spans between the two surfaces being braced against each other may be substantially horizontal, vertical or diagonal.

Therefore, the bracing distance necessary for producing an acceptable bracing strength between the first surface, for example, floor surface 41, against the second surface, for example, door surface 42, can vary, according to the point of preferred engagement with the first surface, for example a door handle's rotation cylinder, not shown. And, as will be apparent to one skilled in the art, in the instance where it is desirable to have a bracing member 12 with a fixed-length, the most suitable length for bracing member 12 will be predetermined based on the intended application. Nonetheless, as illustrated in FIG. 6, the convex end member 22 enables a bracing device 10 with a fixed-length bracing member 12 to adapt to a wide range of bracing distances between the first and second surfaces, according to the point of preferred engagement with the first surface. Of course, this is a significant advantage provided by the applicants' invention versus conventional bracing devices since point of preferred engagement with the first surface can vary from site to site or even within a selected application site.

The conventional devices discussed herein either cannot be adapted to accommodate different bracing distances between the door and floor surfaces or the devices require manipulation to adjust the lengths. Accordingly, the bracing device 10 of the present invention is substantially easier to use while less susceptible to being set in a failure prone orientation than the conventional bracing devices. Moreover, the bracing device 10, while being relatively strong, can be constructed with lightweight materials without compromising the bracing device's strength. Also, as discussed more fully in the illustrative Examples below, the bracing device 10 can be more easily installed and removed versus conventional devices. Therefore, elderly, young children and people operating under pressing and/or time-limited conditions, for example, in the case of a fire, can more easily move or remove the bracing device 10 when necessary.

The bracing device 10 is also readily adaptable to configurations other than that shown in FIG. 6. For example, in residential and commercial security applications, the bracing device 10 is readily adaptable for bracing a door against a wall, a ceiling, or a descending or ascending stair.

Other residential and commercial applications include bracing building components and materials in different steps of construction or demolition such as bracing sheet rock, framing, walls, roofs and scaffolding.

Emergency response applications including, without limitation, propping overturned vehicles, trailers, tilted or fallen walls arising from accidents, fires, explosions, earthquakes, tornadoes and other natural or non-natural incidents. For example, vehicles, trailers and other objects can be propped in a first position by a first bracing device and then moved to a second position by a second bracing device and so on to free a person or animal trapped in the overturned vehicle, trailer or under another large object. Also, a bracing device with at least one inflatable convex end member can be placed in a confined space where a person or animal is trapped and subsequently inflated. The inflatable end member is inflated to move the object, as appropriate, while bracing the object so the person or animal can be freed and brought to safety.

The following non-limiting examples of embodiments of the present invention that may be made and used as claimed herein are provided for illustrative purposes only.

EXAMPLE 1

A bracing device of the type illustrated in FIG. 1A, having a convex end member and a Y fork-shaped end member was constructed with the following dimensions and materials:

Material of Construction:

| | |
|---|---|
| Bracing Member: | Fiberglass |
| Convex end Member: | KRATON ® styrene-butadiene<br>Durometer: 65A |
| Y Fork-shaped End Member: | Polypropylene<br>Durometer: 70D |

Dimensions:

Bracing Member:

38.5 inches long 1.25 inches outside diameter 1.00 inches inside diameter

Convex End Member:

5.8 inches radius 4.44 inches arc length 2.25 inches wide at base 9.6 sq. inches available for contacting surface Y Shaped End Member:

5.25 inches long 19.8° angle 1.36 inches deep at base of Y

Bracing Device:

43.5 inches assembled length

The bracing device of the dimensions above is suitable for bracing a door with a door knob height in the typical range of 34 to 40 inches. However, as shown in Examples 2 and 3, the bracing device is effective in the broader range of 28 to 42 inches, without adjusting the height of the bracing member.

Each of the convex end and Y shaped end members was formed with an aperture for receiving an end of the bracing member. The convex and Y shaped end members were press-fit onto the bracing member.

For convenience, the bracing device described under this Example will hereinafter be referred to an "Example 1 Device."

Control Device

The Control Device has the same bracing member and Y-shaped end member as for the Example 1 Device. However, the foot member is a circular shaped rubber cap about 1.8" in diameter at the base and with a raised circular rib (1.25" diameter, 0.06" wide and 0.06" high) for frictionally engaging the floor surface ("Control Device"). The rubber cap was fixed on one end of the bracing member with the base perpendicular to the bracing member.

EXAMPLE 2

This test compares the fit and bracing strength of the Example 1 Device with commercially available bracing devices and the Control Device, described above, when used to brace a door against a floor surface. The Example 1 Device showed similar or better contact surface area and good fit and bracing strength for a wide range of door knob heights. However, as discussed in more detail below, the Example 1 Device did not require length adjustment in order to provide comparable or better fit and bracing strength at most heights in the test range. In contrast, the commercially available devices required length adjustment to be effective over the same range.

The Example 1 Device was tested to determine the contact surface area of the convex end member on a floor when the Y shaped end member cradled a door knob at different heights. The contact surface area was compared with that of two commercially available devices.

One of the commercially available devices was the BIG JAMMER™ available from Mace Security International, Bennington, Vermont, U.S.A. The BIG JAMMER™ has a telescoping bar (20 gauge steel) with a cradle for engaging a door knob at one end and a rigid planar foot fixed to the other end. The foot is not moveable with respect to the bar. The angle between the flat base of the foot and the longitudinal axis of the bar is about 105°.

The other commercially available device was the DOOR SECURITY BAR™ available from Master Lock, Milwaukee, Wisconsin, U.S.A. The DOOR SECURITY BAR™ has a telescoping bar (aluminum) with a cradle for engaging a door knob at one end and a rigid, planar foot that is partially rotatable in a ball and socket arrangement with the bar. The ball and socket arrangement provides a 90–120° angle range between the base of the rigid planar foot and the longitudinal axis of the bar. A locking lever is provided at the top of the bar for pushing the cradle up against the door knob once the bar is in position.

The length of the Example 1 Device's bracing member was fixed, any required height adjustment being provided by the convex end member. The length of the BIG JAMMER™ and the DOOR SECURITY BAR™ devices is adjusted by aligning holes in the bar and extending a pin through the bar.

The contact surface area for each device was measured for each device at different door knob heights. The door knob height was measured from the center of the knob to the bottom of the door. The contact surface area was also measured for the Control Device.

Each bracing device was placed under the door knob at the height being tested. In the case of the Example 1 Device and the Control Device, the length of the bracing member was not adjustable and therefore no height adjustment was made to place the device in position.

In the case of the BIG JAMMER™ and the DOOR SECURITY BAR™ devices, the length of the bar was adjusted, as described above, to place the devices' feet in a position to most securely engage the floor.

Once in position, the contact surface area was measured for each device. The results are listed in Table 1.

TABLE 1

| Device | Foot Member's Total Surface Area | Foot Member's Actual Contact Surface Area (sq. inches) with the Floor Surface Under Static Conditions Door Knob Height (inches) (Typical door knob height: 34–40 inches) | | | | | | | | | |
|---|---|---|---|---|---|---|---|---|---|---|---|
| Description | (sq. inches) | 28 | 30 | 32 | 34 | 36 | 38 | 40 | 42 | 44 | 46 |
| Example 1 Device | 9.6 | 1.1 | 1.1 | 1.7 | 2.2 | 2.5 | 4.0 | 4.5 | 5.0 | N/A* | N/A* |

TABLE 1-continued

| Device Description | Foot Member's Total Surface Area (sq. inches) | Foot Member's Actual Contact Surface Area (sq. inches) with the Floor Surface Under Static Conditions Door Knob Height (inches) (Typical door knob height: 34–40 inches) | | | | | | | | | |
|---|---|---|---|---|---|---|---|---|---|---|---|
| | | 28 | 30 | 32 | 34 | 36 | 38 | 40 | 42 | 44 | 46 |
| BIG JAMMER ™ | 6.3 | 0.1 | 0.4 | 0.8 | 0.9 | 1.5 | 2.5 | 3.5 | 5.0 | 5.5 | N/A* |
| DOOR SECURITY BAR ™ | 6.3 | 0.3 | 1.0 | 2.2 | 5.0 | 5.0 | 5.0 | 5.0 | 5.0 | 5.0 | N/A* |
| Control Device | 2.4 | 0.1 | 0.2 | 0.2 | 0.3 | 0.3 | 0.4 | 0.5 | 0.8 | 1.0 | N/A* |

*N/A means that the specified device was not functional at the indicated height because the bracing member length was not adjustable, as in the case of the Example 1 Device and the Control Device, or the height adjustment was at its maximum, as in the case of the BIG JAMMER ™ and the DOOR SECURITY BAR ™ devices.

As mentioned above, the bracing member's length for the Example 1 Device was not adjustable. However, as shown in Table 1, the Example 1 Device was effective, at the same length, for door knob heights in the range 28" to 42", because of the convex end member. Typical door knob heights are in the range of 34 to 40 inches and the Example 1 Device's length was selected for this range. It will be understood however, that the bracing member could be longer and/or the convex end member could have a longer arc for applications where there is a greater distance between the first and second surfaces. Also, as described above, the bracing member could have an adjustable length for even greater adaptability. However, as demonstrated by Table 1, a length adjustable bracing member is not required for operability of the Example 1 Device within a desired range.

In contrast, the length of the telescoping bars for the BIG JAMMER™ and the DOOR SECURITY BAR™ devices had to be adjusted for each of the door knob heights in Table 1, in order to provide sufficient contact surface area between the foot and floor surface.

The data in Table 1 shows that the feet of the BIG JAMMER™ and the devices did not fully contact the floor surface at any height. The BIG JAMMER™ description above indicates that there is about a 105° angle between the fixed flat base of the foot and the longitudinal axis of the bar. Accordingly, the device's bar must be positioned at a vertical angle of about 75° to ensure the device's rigid, planar foot securely engages the floor surface.

Likewise, the DOOR SECURITY BAR™ there is a 90–120° angle range between the base of the foot and the longitudinal axis of the bar. Accordingly, the device's bar must be positioned at a 60–90° angle to ensure the device's planar foot securely engages the floor surface. The foot will not fully contact the floor surface with any deviation from this angle range.

The contact surface area data in Table 1 were determined while the bracing devices were in an "at rest" position, where no pressure or force is applied against the bracing device (i.e., under static conditions). As long as the devices remain in position, the contact surface area for the BIG JAMMER™ and the DOOR SECURITY BAR™ devices will not change.

However, because of the curvature and compressibility of the convex end member, the contact surface area for the Example 1 Device will increase, as compared with the static contact surface area, as pressure and/or force is applied against the bracing device. Accordingly, the Example 1 Device can gain some additional strength as pressure and/or force is applied against the bracing device.

The angle produced by the intersection of the bracing member's longitudinal axis with the floor was measured for each device at each of the door knob heights in Table 1. The "Fit" and bracing strength for each device at each height was also qualitatively determined.

The bracing devices were put in position as described above for the measurements in Table 1. Once in position, each device was visually inspected to qualitatively assess the closeness, tolerance and symmetry of the door knob cradle against the door knob and the door, the intersection of foot at the floor surface, and the foot's frictional engagement with the floor surface. This qualitative assessment of the "Fit" was rated as good, fair or poor. In Table 2, "G" indicates good fit, "F" indicates fair fit and "P" indicates poor fit.

The bracing strength for each device was then qualitatively assessed by applying a static pressure against the door, while the device was in position. The static pressure was applied, in a consistent manner for each device at each door knob height, by a 210-lb person leaning against the side of the door opposing the side on which the bracing device was placed. Bracing strength was rated as good ("G") when there was negligible to no slippage under the applied static pressure. When there was some slippage, indicating that a possible increase in pressure could result in failure, the device was rated as being fair ("F"). A device that slipped out of position under the applied static pressure was rated as poor ("P").

The Fit and Bracing Strength results for the Example 1 Device and the BIG JAMMER™ and the DOOR SECURITY BAR™ devices are presented in Table 2.

TABLE 2

| Device Description | Intersection Angle at Floor (degrees) (Angle Between Device's Longitudinal Axis and the Floor Surface) Door Knob Height (inches) (Typical door knob height: 34–40 inches) | | | | | | | | | |
|---|---|---|---|---|---|---|---|---|---|---|
| | 28 | 30 | 32 | 34 | 36 | 38 | 40 | 42 | 44 | 46 |
| Example 1 Device | 30° | 37° | 45° | 52° | 60° | 70° | 75° | 80° | N/A* | N/A* |
| Fit | G | G | G | G | G | G | G | G | N/A* | N/A* |
| Bracing Strength | F | G | G | G | G | G | G | G | N/A* | N/A* |
| BIG JAMMER ™ | 45° | 60° | 62° | 65° | 70° | 75° | 75° | 75° | 80° | N/A* |
| Fit | F | G | G | G | G | G | G | G | F | N/A* |
| Bracing Strength | F | F | G | G | G | G | G | G | F | N/A* |
| DOOR SECURITY BAR ™ | 45° | 45° | 50° | 60° | 65° | 75° | 75° | 75° | 80° | N/A* |
| Fit | F | G | G | G | G | G | G | G | F | N/A* |
| Bracing Strength | F | F | G | G | G | G | G | G | F | N/A* |

TABLE 2-continued

| Device | Intersection Angle at Floor (degrees) (Angle Between Device's Longitudinal Axis and the Floor Surface) Door Knob Height (inches) (Typical door knob height: 34–40 inches) | | | | | | | | | |
|---|---|---|---|---|---|---|---|---|---|---|
| Description | 28 | 30 | 32 | 34 | 36 | 38 | 40 | 42 | 44 | 46 |
| Control Device | 30° | 37° | 45° | 52° | 60° | 70° | 75° | 80° | N/A* | N/A* |
| Fit | P | P | P | P | P | P | P | P | N/A* | N/A* |
| Bracing Strength | P | P | P | P | P | P | P | P | N/A* | N/A* |

*N/A means that the specified device was not functional at the indicated height because the bracing member length was not adjustable, as in the case of the Example 1 Device and the Control Device, or the height adjustment was at its maximum, as in the case of the BIG JAMMER ™ and the DOOR SECURITY BAR ™ devices.

Each of the devices demonstrated comparable performance on wood, tile, carpet and concrete floor surfaces.

The "Fit" for the Example 1 Device was good at the full range of door knob heights from 28" to 42", without requiring height adjustment, for intersection angles of 30° to 80°. As mentioned above, because the bracing member length was not adjustable, the Example 1 Device was not functional at door knob heights of 44" to 46". The Example 1 Device showed little or no slippage under the applied static pressure for door knobs 30" to 42" high. The Example 1 Device slipped slightly when braced against a door knob 28" high.

Because the BIG JAMMER™ and the DOOR SECURITY BAR™ devices were length-adjustable, the commercially available devices fit well for door knob heights in the range 30" to 42". However, in order for the same bar to provide that range, the length of the bar had to be adjusted, whereas the Example 1 Device did not require length adjustment. Neither commercially available device was functional at 46". The intersection angle at the floor ranged from 45° to 80°. However, because the length was adjusted for different heights, the angle was 75° for door knobs 38° to 42° high.

The BIG JAMMER™ and the DOOR SECURITY BAR™ devices showed little or no slippage for 32" to 42" door knobs and some slippage for 28" to 30" and 44" door knobs. The "F" performance rating was particularly due to poor foot member contact surface area between the planar foot member and the floor surface at an angle at which the device had to be positioned to fit under the door knob.

The Control Device performed poorly and fit poorly at all heights.

EXAMPLE 3

This test illustrates the benefit of using a convex end member to engage a floor surface, as compared with a conventional bracing device foot member that is substantially rigid and planar versus the convex end member.

Accordingly, the respective foot members of the BIG JAMMER™, the DOOR SECURITY BAR™ and the Control Devices were adapted to the same bracing member and Y-shaped end member used for the Example 1 Device. The foot members were adapted to the Example bracing member without compromising the connectivity of the respective foot members to the bracing device. Accordingly, the ball and socket component for the DOOR SECURITY BAR™ was functional on the Example 1 bracing member.

Each foot member's grip was compared for each modification at different door knob heights on a non-treated, non-painted, substantially smooth conventional residential concrete garage floor (hereinafter "concrete garage floor").

Each foot member's grip was determined qualitatively by placing the device in position and pushing against the door to see if the device's foot slipped against the concrete garage floor. Each foot member's grip was qualitatively rated in the same manner as the bracing strength test in Example 2. The degree of slippage was rated as being "G" for substantially no slippage on the floor, "F" for slight slippage on the floor or "P" for significant slippage on the floor. The results are presented in Table 3.

TABLE 3

| Foot Member Type Adapted to Bracing Member and Y-Shaped End Member Used for the Example 1 Device | Grip Rating Door Knob Height (inches) (Typical door knob height: 34–40 inches) | | | | | | | | | | | |
|---|---|---|---|---|---|---|---|---|---|---|---|---|
| | 31 | 32 | 33 | 34 | 35 | 36 | 37 | 38 | 39 | 40 | 41 | 42 |
| Convex End Member | G | G | G | G | G | G | G | G | G | G | G | G |
| Rigid, Planar BIG JAMMER ™ foot | P | P | P | P | P | P | P | G | G | G | G | N/A* |
| Rigid, Planar DOOR SECURITY BAR ™ foot | P | F | F | G | G | G | G | G | G | G | G | G |
| Rubber Cap (Control Device) | P | P | P | P | P | P | P | P | P | P | P | N/A* |

*N/A means that the specified device was not functional at the indicated height because the bracing member length was not adjustable.

The convex end member of the Example 1 Device demonstrated substantially no slippage against the concrete garage floor surface (described above) for door knob heights ranging from 31" to 42". However, when the convex end member was replaced with the fixed substantially rigid planar BIG JAMMER™ type foot member, the bracing device showed significant slippage on the concrete garage floor at door knob heights ranging from 31" to 37", but demonstrated substantially no slippage for door knob heights at 38" to 41". The grip performance improved somewhat for door knob heights from 34" to 42" when the DOOR SECURITY BAR™'s partially rotatable, but substantially rigid, planar type foot member was adapted to Example 1's bracing member with a Y-shaped end member. However, grip was poor to fair at 31" to 33" door knob heights. Also, the Control Device demonstrated poor grip throughout the tested door knob height range.

EXAMPLE 4

This test compares the ease of use for the Example 1 Device with the two commercially available devices used in Example 2. The devices were first compared for the number of moving parts in a "straight from the box" state. The results are shown in Table 4. Each of the products was ready to use "straight from the box" and did not require assembly. However, some adjustments were required to properly install the bracing device to obtain an acceptable bracing strength. Table 4 also demonstrates the number and nature of adjustments required to place the devices "straight from the box" into service as a door bracing device.

TABLE 4

| Device Description | Number of Moving Parts | Number of Adjustments Required | Nature of Adjustment Required, if any And Installation Description |
|---|---|---|---|
| Example 1 Device | 0 | 0 | Y-shaped end member is placed under door knob to cradle door knob while convex end member is pushed against floor |
| BIG JAMMER ™ | 3 | 1 | Length of bar is adjusted by removing pin holding telescoping bar members in position relative to one another, moving one telescoping bar member with respect to the other to the appropriate length and inserting pin through aligned holes in the telescoping bar members<br>Door knob cradle placed under door knob and flat foot pushed against floor |
| DOOR SECURITY BAR ™ | 6 | 3 | Length of bar is adjusted by removing pin holding telescoping bar members in position relative to one another, moving one telescoping bar member with respect to the other to the appropriate length and inserting pin through aligned holes in the telescoping bar members<br>Angle of rotatable foot is adjusted for angle of device with respect to door<br>Door knob cradle placed under door knob and flat foot pushed against floor<br>Final length adjustment by pushing lever |

The devices were then tested for the time required to put the device into use as a door bracing device. An adult female test subject unfamiliar with door security devices was asked to read the instructions for each device and then the time required for the test subject to independently install the device under the same door and door knob height was measured. For each measurement, the test subject was seated 8 feet from the test door.

In the first attempt, the test subject was able to install the Example 1 Device in 20 seconds. However, the test subject was not able to correctly install the BIG JAMMER™ or DOOR SECURITY BAR™ devices on the first attempt after 90 seconds and 165 seconds, respectively. The test subject was then coached by one of the inventors for proper installation of each of the devices. Using the same procedure described above, the test subject was timed for proper installation of the devices. The results are presented in Table 5.

TABLE 5

| Device | Time required for installation on 1st attempt (seconds) | Time required for installation after coaching (seconds) |
|---|---|---|
| Example 1 Device | 20 | 10 |
| BIG JAMMER ™ | Unsuccessful after 90 | 135 |
| DOOR SECURITY BAR ™ | Unsuccessful after 165 | 45 |

The time shown in Table 5 includes any required length adjustment, as described in Table 4.

Tables 4 and 5 demonstrate the ease with which the Example 1 Device was put into position. The test subject was able to place the Example 1 Device in position in considerably less time than the BIG JAMMER™ and DOOR SECURITY BAR™ devices. This is particularly important when the device is used by elderly, young children and people operating under pressing and/or time-limited conditions. Because of the convex end member, the device is readily adaptable to a wide range of door knob heights and requires little adjustment when being placed in position. Moreover, these results show that a bracing device with a convex end member requires substantially less rigorous attention to orienting and/or adjusting the device than conventional bracing devices. As discussed above, this benefit can be particularly important where the bracing device is used in an environment where the door knob height or other second end engagement point is likely to vary.

EXAMPLE 5

Each of the Example 1, BIG JAMMER™ and DOOR SECURITY BAR™ devices were then tested for strength against impact.

The Example 1 Device was placed in position under a door knob at a height of 32 inches. Three adult males with a combined weight of about 675 pounds provided an approximate mass of 21.0 slugs using 32.2 ft/sec$^2$ as the acceleration under the earth's gravitational force constant (i.e., 675 lbs/32.2 ft/sec$^2$). They first pushed against the door and then rammed the door from a distance of 3 feet, at a velocity of about 3 ft/sec (about 2 mph), to produce an impact with a calculated kinetic energy of about 94.5 slug·ft$^2$/sec$^2$ or 94.5 ft·lb, according to the equation:

$$\text{kinetic energy} = \tfrac{1}{2}\, mv^2$$

where m is mass (slug=lb·sec$^2$/ft); and v is velocity (ft/sec).

The results of the strength test are presented in Table 6.

TABLE 6

| Device Description | Total Mass (slugs) | Calculated Kinetic Energy (ft · lb) | Failures 32" Door Knob Height | Failures 42" Door Knob Height |
|---|---|---|---|---|
| Example 1 Device | 21.0 | 94.5 | None | None |
| BIG JAMMER ™ | 21.0 | 94.5 | None | None |
| DOOR SECURITY BAR ™ | 21.0 | 94.5 | None | None |

The Example 1 Device resisted the impact in both tests. The tests were repeated for a door knob height of 42 inches. Again, the Example 1 Device resisted the impact in both tests.

The same tests were performed with the BIG JAMMER™ and DOOR SECURITY BAR™ devices at 32 inches and 42 inches. The BIG JAMMER™ and DOOR SECURITY BAR™ devices also resisted the impact in all tests.

The ability to withstand impact in a door security application was comparable for each of the Example 1, BIG JAMMER™ and DOOR SECURITY BAR™ devices.

EXAMPLE 6

Each of the Example 1, BIG JAMMER™ and DOOR SECURITY BAR™ devices were then tested for resistance to compression pressure using a Tinius-Olsen electromechanical universal press. All devices were tested at a total length of 29 inches, and where required, the bracing member were cut to length. Each device was placed vertically into the press and a gradual, increasing, perpendicular force was applied to the device until the device failed. The pressure at failure and the nature of failure were recorded for each device. The results are presented in Table 7.

TABLE 7

| Device Description | Pressure Applied to Failure @ 29 inch length ($lb_f$) | Point of Failure |
|---|---|---|
| Example 1 Device | 2460 | Y-shaped end member deformed, thin crack developed inside bracing member. Convex end member substantially flattened out. |
| BIG JAMMER ™ | 637 | Y-shaped end member so grossly deformed that the device could not be retained in the press. |
| DOOR SECURITY BAR ™ | 1400 | Y-shaped end member deformed around upper adjustment mechanism, slight buckling of bracing member at pin holes, foot slightly jammed into bracing member. Ball and socket assembly about to fracture. |

The Example 1 Device was able to bear 3.9 times as much vertical pressure as the BIG JAMMER™ device and 1.8 times as much vertical pressure as the DOOR SECURITY BAR™ device.

These results show two basic benefits arising from the Example 1 Device's construction. First, its second end member (in this case a Y-shaped end member) and single piece bracing member ensure the applied force is directed to the convex end members. Second, the convex end member's continued compression with increasing pressure, absorbed energy that would have otherwise placed more stress on the Y-shaped end member and/or bracing member, thereby averting their failure under a lower compression pressure. This shows how the convex shape provides at least two inherent performance benefits, among others.

First, it can serve as an energy sink, in accordance with its hardness, in part because of its convex curvature, which offers a "spring-like" property. In contrast, the conventional rigid, planar foot members have no "spring-like" property. And, consequently, substantially all energy applied to a conventional bracing device stresses primarily the bracing member and the second end member, which then become the device's weak link earlier in the applied energy curve.

Second, the convex end member enables the use of a single-piece bracing member in constructing a bracing device adaptable to a wide range of bracing distances between two surfaces being braced against each other. And, again, a single-piece construction for the bracing member provides inherently greater strength versus a multiple piece assembly, like that found with conventional bracing devices described above.

Thus, the convex end member enables a lighter weight design and material(s) of construction, where advantageous to do so, without compromising the performance needed for the intended application. Of course, such a lighter weight design, coupled with the device's improved adaptability to a wide range of bracing distances without requiring a bracing member length adjustment, can be particularly beneficial under emergency response or other stressful conditions.

Preferred devices for practicing the invention have been described. It will be understood that the foregoing is illustrative only and that other embodiments can be employed without departing from the true scope of the invention defined in the following claims.

We claim:

1. A bracing device for bracing a first surface against a second surface, the device comprising:

(a) a bracing member having a first end and a second end, and a first end member affixed to the first end, wherein the first end member has at least one aperture, having an aperture centerline, to serve as a receptacle for the first end of the bracing member;

(b) wherein at least a portion of the first end member has a substantially convex curvature and material adapted to frictionally engage the first surface, wherein (i) the aperture centerline relative to a radius line of convex curvature produces an angle between the aperture centerline and the radius line greater than 0 degrees and less than 90 degrees; and (ii) the convex curvature allows the bracing device to be adapted to a predetermined range of bracing distances between the first and second surface so that the desired bracing strength can be obtained; and (c) wherein the second end is adapted to engage the second surface.

2. The bracing device of claim 1 wherein the radius of convex curvature is predetermined so the bracing device may be adapted to a predetermined range of bracing distances between the first and second surface so that the desired bracing strength can be obtained.

3. The bracing device of claim 1 wherein the radius of convex curvature is predetermined so the bracing device may be adapted to a predetermined range of bracing distances between the first and second surface so that the desired bracing strength can be obtained without requiring bracing member length adjustment.

4. The bracing device of claim 1 further comprising a second end member affixed to the second end.

5. The bracing device of claim 1 wherein the radius of convex curvature is in a range of from about 1 inch to about 48 inches.

6. The bracing device of claim 1 wherein the radius of convex curvature is in a range of from about 1 inch to about 7 inches.

7. The bracing device of claim 1 wherein the arc length of the convex shape is in a range of from about 1.5 inches to about 151 inches.

8. The bracing device of claim 1 wherein the arc length of the convex shape is in a range of from about 1 inch to about 7 inches.

9. The bracing device of claim 1 wherein the first end member is formed from a material having a shore A durometer hardness in a range of from about 25 to about 95.

10. The bracing device of claim 1 wherein the first end member is formed from a material having a shore A durometer hardness in a range of from about 60 to about 80.

11. The bracing device of claim 1 wherein the first end member is formed with a first core material and a second external layer material having a shore A durometer hardness in a range of from about 25 to about 95.

12. The bracing device of claim 1 wherein the first end member is formed with a first core material and a second external layer material having a shore A durometer hardness in a range of from about 60 to about 80.

13. The bracing device of claim 4 wherein the second end member has a cradling means for engaging at least a portion of the hardware affixed to a door.

14. The bracing device of claim 4 wherein at least a portion of the second end member has a convex shape and material adapted to frictionally engage the second surface.

15. The bracing device of claim 14 wherein the radius of convex curvature is predetermined so the bracing device may be adapted to a predetermined range of bracing distances between the first and second surface so that the desired bracing strength can be obtained.

16. The bracing device of claim 14 wherein the radius of convex curvature is predetermined so the bracing device may be adapted to a predetermined range of bracing distances between the first and second surface so that the desired bracing strength can be obtained without requiring bracing member length adjustment.

17. The bracing device of claim 1 wherein the second end is adapted to be inserted into an aperture on the second surface.

18. The bracing device of claim 1 wherein the bracing member is selected from the group consisting of a substantially solid member, a substantially hollow member and a partially hollow, partially solid member.

19. The bracing device of claim 1 wherein the bracing member is comprised of at least first tubular component, a second tubular component and a bracing component connecting means disposed therebetween.

20. The bracing device of claim 4 wherein at least a portion of the second end member has a tubular-connecting means for connecting the second end member to the second end of the bracing member.

21. The bracing device of claim 20 wherein the tubular-connecting means has at least a male component adapted to substantially conform to the inside diameter of a substantially hollow tubular second end of the bracing member.

22. The bracing device of claim 21 wherein the tubular-connecting means further comprises a sleeve circumscribing the male component and annulus located therebetween so that the sleeve is adapted to substantially conform to the outside diameter of the substantially hollow tubular second end of the bracing member.

23. The bracing device of claim 1 wherein the angle between the aperture centerline and the radius line is in a range from about 10 degrees to about 30 degrees.

24. The bracing device of claim 1 wherein the convex end member is inflatable.

25. The bracing device of claim 14 wherein the second convex end member is inflatable.

* * * * *

UNITED STATES PATENT AND TRADEMARK OFFICE

CERTIFICATE OF CORRECTION

PATENT NO. : 6,513,778 B2 
DATED : February 4, 2003
INVENTOR(S) : R. Duane Hefley, Kenneth A. Strode and Micheal S. Andrich It is certified that error appears in the above-identified patent and that said Letters Patent is hereby corrected as shown below:

Title page,
Item [73], Assignee, name "Evertax Corporation" should read
-- Evertex Corporation --

Column 4,
Line 3, "FIG. 5" should read -- FIG. 5B --

Column 15,
Lines 57-58, "38° to 42° high" should read -- 38" to 42" high --

Signed and Sealed this

Fifteenth Day of April, 2003

JAMES E. ROGAN
*Director of the United States Patent and Trademark Office*